US009842517B1

(12) United States Patent
Amami et al.

(10) Patent No.: US 9,842,517 B1
(45) Date of Patent: Dec. 12, 2017

(54) IDENTIFICATION BRACELET

(71) Applicants: Amtec Sales, Inc., Miami, FL (US); Dykam Ein Harod (Meuhad) Agricultural Cooperative Association Ltd., Kibbutz Ein Harod Meuhad (IL)

(72) Inventors: Iftach Amami, Kibbutz Ein Harod Meuhad (IL); Yoav Brand, Kibbutz Ein Harod Meuhad (IL); Leonid Gribets, Afula (IL)

(73) Assignees: Print Media, Inc., Miami, FL (US); Dykam Ltd., Kibbutz Ein Harod (IL)

( * ) Notice: Subject to any disclaimer, the term of this patent is extended or adjusted under 35 U.S.C. 154(b) by 0 days.

(21) Appl. No.: 15/234,650

(22) Filed: Aug. 11, 2016

(51) Int. Cl.
*A44C 5/00* (2006.01)
*G09F 3/00* (2006.01)
*G09F 3/02* (2006.01)

(52) U.S. Cl.
CPC ..... *G09F 3/005* (2013.01); *G09F 2003/0251* (2013.01)

(58) Field of Classification Search
CPC ..... G09F 3/005; G09F 3/0288; G09F 3/02; G09F 2003/0226; G09F 3/00; G09F 3/0297; G09F 3/10; G09F 2003/0254
USPC ..... 40/633
See application file for complete search history.

(56) References Cited

U.S. PATENT DOCUMENTS 3,825,463 A 7/1974 Amann
4,817,310 A * 4/1989 Breen ..... A45C 13/42 40/6
4,914,843 A 4/1990 DeWoskin
5,026,084 A * 6/1991 Pasfield ..... G09F 3/005 283/114
5,279,057 A 1/1994 Melin et al.
5,364,133 A 11/1994 Hofer et al.
5,581,924 A 12/1996 Peterson
5,653,472 A * 8/1997 Huddleston ..... G09F 3/005 283/75
5,792,299 A 8/1998 Mosher, Jr.
5,799,426 A 9/1998 Peterson
5,979,941 A * 11/1999 Mosher, Jr. ..... B42D 15/00 235/378
6,016,618 A * 1/2000 Attia ..... B42D 15/00 156/289
6,058,637 A 5/2000 Duncan
6,303,201 B1 * 10/2001 Baierl ..... G09F 3/04 283/80
6,479,431 B1 11/2002 McFall et al.
6,546,656 B2 4/2003 Twentier
6,581,973 B2 * 6/2003 Levine ..... G09F 3/0288 283/101

(Continued)

*Primary Examiner* — Shin Kim
(74) *Attorney, Agent, or Firm* — Max Kaganov, PA

(57) ABSTRACT

An identification bracelet is provided. The identification bracelet includes an elongated body, and an end of the body includes a securement portion, which includes an adhesive. A cover having a release section and a gripping section is disposed at the end of the body such that, in an initial configuration, the release section of the cover is engaged with the adhesive of the securement portion. The gripping section is connected to the release section and can be utilized to disengage the cover from the adhesive of the securement portion. When the cover is disengaged, the securement portion is narrower than the rest of the body, resulting in the identification bracelet having a tapered closure.

20 Claims, 6 Drawing Sheets

(56) References Cited

U.S. PATENT DOCUMENTS 6,782,648 B1 8/2004 Mosher, Jr.
7,197,842 B2 4/2007 Ali
7,240,446 B2 7/2007 Bekker
7,320,194 B2 1/2008 Ali et al.
7,322,613 B2 * 1/2008 Penuela ..... G09F 3/0288 283/105
7,520,078 B2 4/2009 Ali et al.
D600,154 S 9/2009 Ali et al.
7,752,794 B2 7/2010 Kerlin
7,765,728 B1 8/2010 Waggoner
7,816,302 B2 10/2010 Hammerslag
7,818,908 B2 10/2010 Greer
7,946,065 B2 5/2011 Ali et al.
8,074,289 B1 12/2011 Carpentier et al.
8,099,890 B2 1/2012 Ali et al.
8,182,893 B2 5/2012 Valenti, Jr. et al.
8,196,323 B2 6/2012 Waltersdorf
8,220,191 B2 7/2012 Waltersdorf
8,327,566 B2 12/2012 Waggoner
8,387,293 B2 3/2013 Wanibuchi
8,490,307 B2 7/2013 Landsman et al.
8,495,829 B2 7/2013 Bekker et al.
8,733,002 B2 5/2014 Kalyankar et al.
8,904,686 B2 12/2014 Greer
9,126,453 B2 9/2015 Takashima et al.
9,147,354 B2 9/2015 Takashima et al.
9,205,694 B2 12/2015 Noe
9,208,428 B2 12/2015 Feder et al.
9,235,994 B1 1/2016 Waltersdorf
9,299,271 B2 3/2016 Scheid
2004/0128892 A1 * 7/2004 Valenti, Jr. ..... G06K 19/07762 40/633
2005/0262746 A1 * 12/2005 Ali ..... G09F 3/005 40/633
2007/0283607 A1 * 12/2007 Sloot ..... G09F 3/005 40/633
2011/0107637 A1 * 5/2011 Bekker ..... G09F 3/005 40/633
2013/0219759 A1 * 8/2013 Kimes ..... G09F 3/10 40/6

* cited by examiner

IDENTIFICATION BRACELET

BACKGROUND

Identification bracelets are widely used to identify persons or objects in various settings, for example, in hospitals and medical facilities as well as in entertainment venues, recreation sites, and other locations where individual identification and/or crowd control is necessary. Such bracelets typically include identifying or other relevant indicia relating to the person or object to which the bracelet is attached, as well as a closure that allows for easy fastening of the bracelet. The closures are usually either mechanical or adhesive, and are configured to render unauthorized removal of the bracelet difficult or easily detectable.

Bracelets having adhesive closures tend to be simpler than those having mechanical closures, in both production and use. The adhesive closure is typically provided at one end of an elongated strip and covered by a release liner. To fasten the bracelet, the release liner is removed so as to expose the adhesive, the bracelet is encircled about an object or appendage, and the adhesive end is then pressed onto the surface of the bracelet. In many identification bracelets, the release liner, the adhesive closure, or both, impart an additional thickness to the bracelet in the area of the closure and liner. This can cause issues when the bracelets are fed through a printer, which can result in jams, as well as when the bracelets are wound up into spools or rolls, which results in uneven or asymmetrical bracelet spools. To mitigate this issue, some bracelets are constructed to have uniform thickness throughout the bracelet, with the adhesive closure and liner being formed from the laminates used to construct the bracelet. However, in both of the above bracelet configurations, the release liner can be difficult to remove, requiring repeated attempts to separate the liner from the adhesive, which can cause delays in situations where large quantities of bracelets need to be deployed, as well as frustration for the user. Moreover, if, upon fastening, a portion of the adhesive closure does not overlap the bracelet, that portion of the adhesive remains exposed and can cause discomfort by contacting the skin or clothing of the wearer. In various applications, carefully positioning the closure so that no adhesive is exposed can likewise cause delays and aggravation.

Certain identification bracelets provide tapered closures, i.e., where the width of the closure portion of the bracelet is narrower than width of the remainder of the bracelet. This allows for a greater margin of error in the fastening of the bracelet, as the likelihood that some adhesive remains exposed is reduced by the narrower width of the closure. However, bracelets having non-uniform width, such as those with tapered closures, can present additional issues. For example, continuous strips of bracelets are typically wound into spools or rolls for convenient storage, transport and handling. Bracelets having non-uniform width do not easily form neat spools due to the variation in bracelet width, and instead form spools with uneven and jagged faces. Such uneven faces tend to have many ridges and grooves of various sizes and configurations due to the edges of the rolled up bracelets lining up in various relations to each other. Because of this, such spools are more difficult to stack without risk of the stack toppling, or to otherwise be placed in compact groups. The bracelets in such spools are also more likely to be damaged, for example by bending and creasing, when the spools are stacked or transported. Moreover, bracelets that have non-uniform width can increase the likelihood of jams when fed through a printer or other high-speed feeder or processor.

Therefore, there exists a need for an identification bracelet, which has an easily operable, tapered adhesive closure, possesses the advantages of bracelets with tapered closures, and avoids the disadvantages of both uniform-width and non-uniform-width bracelets.

SUMMARY

According to one exemplary embodiment, an identification bracelet is provided. The identification bracelet includes an elongated body, and an end of the body includes a securement portion, which includes an adhesive. A cover having a release section and a gripping section is disposed at the end of the body such that, in an initial configuration, the release section of the cover is engaged with the adhesive of the securement portion. When the cover is moved to a non-engagement relationship with the adhesive, the width of the end of the body is less than the width of the remainder of the body.

According to a further exemplary embodiment, the identification bracelet is formed from a first layer and a second layer. The first layer may be bonded to the second layer by an adhesive layer disposed therebetween. The first layer, second layer, and adhesive layer may be coextensive with the body and the adhesive of the securement portion may be formed from the adhesive layer. The release section of the cover includes the second layer, while the gripping section of the cover includes the first layer, second layer, and adhesive layer.

According to a further exemplary embodiment, the gripping section may be disposed between a longitudinal edge of the body and the securement portion. The gripping section is connected to the release section and can be utilized to disengage the cover from the adhesive of the securement portion. When the cover is disengaged, the securement portion is narrower than the rest of the body, resulting in the identification bracelet having a tapered closure.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
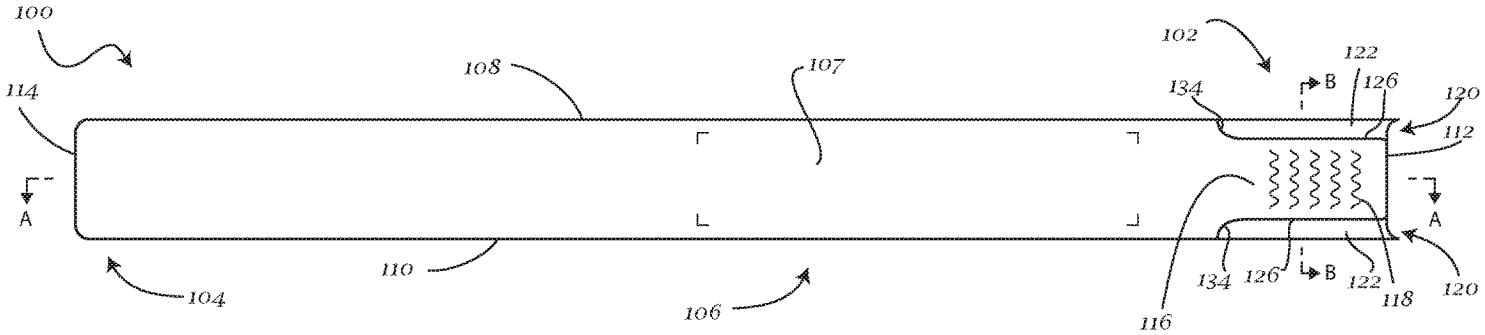
FIG. 1 is a top view of an exemplary embodiment of an identification bracelet.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment and as shown in FIGS. 1-7, a bracelet 100 is disclosed. The bracelet 100 can include a generally elongated body, a first end 102, a second end 104, and a body portion 106 extending therebetween. A first longitudinal edge 108 and a second longitudinal edge 110 extend between a first transverse edge 112 disposed at first end 102, and a second transverse edge 114 disposed at second end 104. In an initial configuration, the width of bracelet 100 can be uniform along substantially the entire length of bracelet 100.

As shown in FIGS. 3-7, bracelet 100 is formed from a plurality of layers of material that are laminated together or otherwise bonded to one another. It should be noted that in the Figures, the thicknesses of the layers are not to scale, and have been enlarged for ease of illustration. In the exemplary embodiment, bracelet 100 can include a top layer 150, a bottom layer 154, and an adhesive layer 152 disposed therebetween. The top layer 150 is adapted for receiving indicia thereon, for example on an information-receiving area 107 of body portion 106, or elsewhere as desired. The indicia may be identifying indicia for the object or person to which bracelet 100 is to be attached, and may be human-readable, machine-readable, or a combination of both. In one exemplary embodiment, top layer 150 may be a thermal-sensitive layer adapted to receive and retain indicia imprinted by a thermal printer, as known in the art. For example, top layer 150 may be a top-side barrier-coated polypropylene film including a thermal coating. Top layer 150 may further be opaque, and may be provided in any desired color or shade. In other embodiments, top layer 150 may be adapted to receive indicia imprinted by any other known printing manner, such as ink or laser printing, to receive handwritten indicia, or to receive and retain adhesive-backed labels thereon. Furthermore, any desired flexible material for the top layer may be used that enables bracelet 100 to function as described herein, including, but not limited to, polyester, polyethylene, and so forth.

In the exemplary embodiment, bottom layer 154 may be adhesively bonded to top layer 150 by adhesive layer 152. Adhesive layer 152 may be, by way of example and not limitation, a UV-radiation-cured acrylic adhesive, and may further be a pressure-sensitive adhesive, or may be any desired adhesive material that enables bracelet 100 to function as described herein.

In some exemplary embodiments, bottom layer 154 can be formed from a polyester material adapted for high-speed converting. Bottom layer 154 may further be moisture-resistant, and, if desired, bottom layer 154 may also be transparent. It should be appreciated that bottom layer 154 may also be formed from any desired flexible material that allows bracelet 100 to function as described herein, including, but not limited to, polypropylene, polyethylene, and so forth. Bottom layer 154 may also include a cue mark 156 on the bottom surface thereof, which may have a contrasting appearance to bottom layer 154 (or, if bottom layer 154 is transparent, to any layer visible through the bottom layer), and may be used by a printing apparatus for determining the appropriate location for printing desired indicia along the length of bracelet 100. Furthermore, in some exemplary embodiments, bottom layer 154 may be releasably bonded to adhesive layer 152, i.e., bottom layer 154 may be substantially securely, but not permanently bonded to adhesive layer 152, thereby allowing bottom layer 154 to be detached from adhesive 152 upon intentional separation by a user, for example by peeling bottom layer 154 away from adhesive 152. Adhesive layer 152, however, may be relatively permanently bonded to top layer 150, or bonded more strongly to top layer 150 than to bottom layer 154. Therefore, when bottom layer 154, or a portion thereof, is peeled away, adhesive 152 may remain bonded to top layer 150 and be exposed on the bottom face of top layer 150.

Such a construction of the bracelet results in bracelet 100 having substantially uniform thickness throughout, providing an advantage for feeding the bracelet through printers by reducing the likelihood of jams, and for winding up a plurality of connected bracelets (described further below) into symmetrical rolls or spools. However, it should be appreciated that top layer 150 and bottom layer 154 may each be formed from a single sheet of material, or may each be formed from a plurality of laminated sheets of material, as desired, without departing from the spirit of the invention.

Furthermore, the exemplary embodiments describe an adhesive layer 152 formed from a single type of adhesive that extends throughout the bracelet 100 and is sandwiched between top layer 150 and bottom layer 154. However, it should also be understood that, in alternate embodiments, top layer 150 and bottom layer 154 may be bonded in any desired manner, or by any desired quantity or type of adhesives, that allow bracelet 100 to function as described herein. In such alternate embodiments, an adhesive layer as described herein may be provided at the securement portion 116 of bracelet 100, or, in yet other embodiments, an adhesive layer may be provided only at securement portion 116 of bracelet 100.

First end 102 of bracelet 100 may include a securement portion 116 and a peel-off cover 120, with the width of securement portion 116 being less than the width of the remainder of bracelet 100, i.e. body portion 106 and second end 104. Securement portion 116 can also include a pattern of tamper-evident score lines 118, which can be formed through at least top layer 150 and adhesive layer 152.

The peel-off cover 120 allows for conveniently exposing the adhesive layer 152 of securement portion 116 to allow for fastening bracelet 100. To that end, cover 120 can include at least one gripping section 122 and a release section 124. A gripping section 122 can include top layer 150, adhesive layer 152, and bottom layer 154, while release section 124 can include bottom layer 154 but not top layer 150 nor adhesive layer 152.

As viewed from the top in FIG. 1, gripping sections 122 can be provided along the longitudinal edges 108, 110 of bracelet 100. The boundaries of gripping section 122 may be defined by a longitudinal edge 108/110, first transverse edge 112, and a score line 126 extending between longitudinal edge 108/110 and first transverse edge 112. As shown in the cross-section in FIG. 5, score line 126 may be formed through top layer 150 and adhesive layer 152, but not through bottom layer 154.

Figure 2:
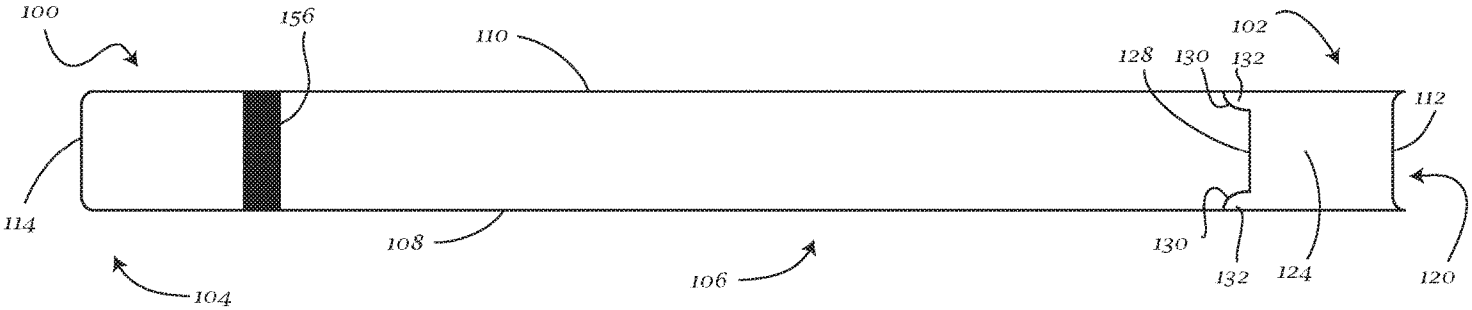
FIG. 2 is a bottom view of an exemplary embodiment of an identification bracelet.
Figure 3:
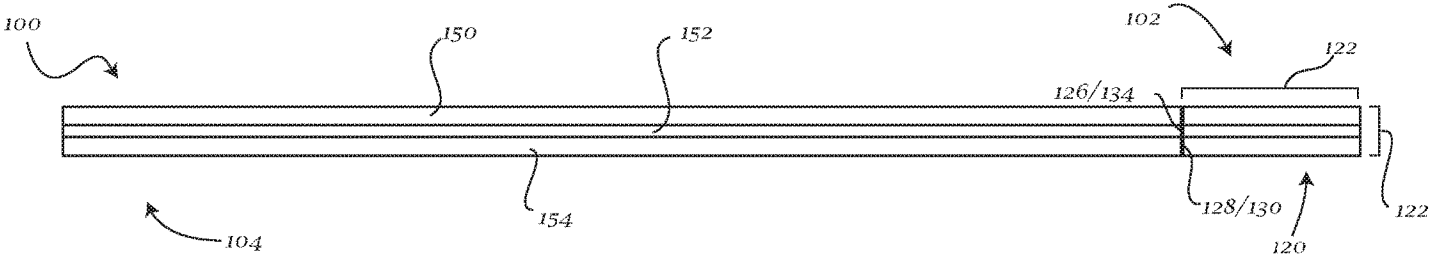
FIG. 3 is a side view of an exemplary embodiment of an identification bracelet.
Figure 4:
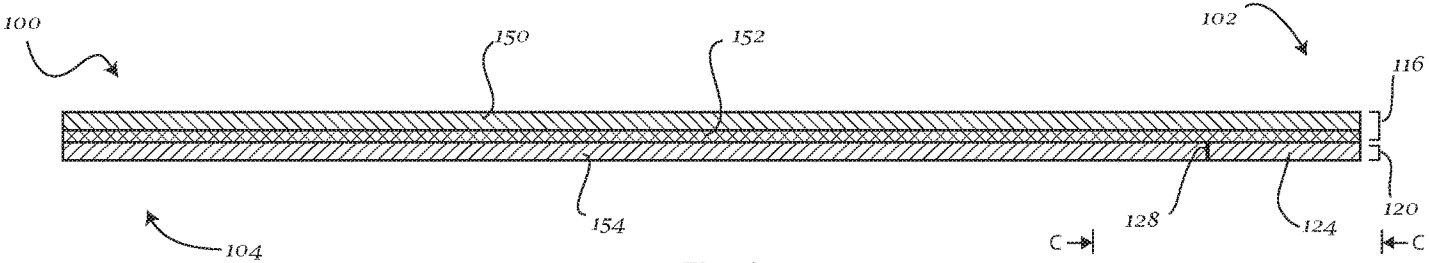
FIG. 4 is a cross-sectional view of an exemplary embodiment of an identification bracelet along line A-A of FIG. 1.
Figure 7:
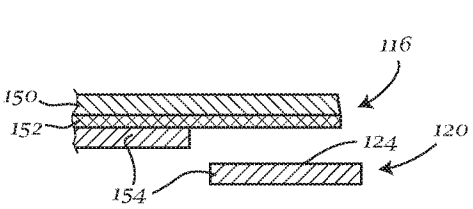
FIG. 7 is a view of section C-C of FIG. 4, showing the peel-off cover separated.
Figure 6:
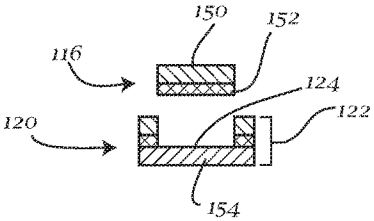
FIG. 6 is the cross-sectional view of FIG. 5 showing the peel-off cover separated.
Figure 5:
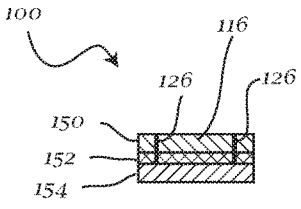
FIG. 5 is a cross-sectional view of an exemplary embodiment of an identification bracelet along line B-B of FIG. 1.

A bottom view of bracelet 100 and cover 120 is shown in FIG. 2. The boundaries of cover 120 may be defined by first transverse edge 112, longitudinal edges 108, 110, and a score line 128 extending between longitudinal edges 108 and 110. As shown in the cross-section in FIG. 4, score line 128 may be formed through bottom layer 154, but not through top layer 150 and adhesive layer 152.

In this exemplary embodiment, score line 128 extends substantially transversely across bracelet 100. However, proximate longitudinal edges 108/110, score line 128 can include extending portions 130 that project towards second end 104 prior to reaching a longitudinal edge 108 or 110. Each extending portion 130 of score line 128 defines a tab 132, and is substantially coextensive with a corresponding extending portion 134 of score line 126. Consequently, along the length of each extending portion 130, a cut line is effectively formed through top layer 150, adhesive layer 152 and bottom layer 154, i.e., through the entire thickness of bracelet 100. The tab 132 and the cut line formed through bracelet 100 can provide a starting point for the separation of cover 120 from bracelet 100 so as to increase the ease of such separation. It should also be appreciated that various shapes and configurations for the score lines disclosed herein and for cover 120 may be contemplated and provided without departing from the scope of the invention.

Figure 8:
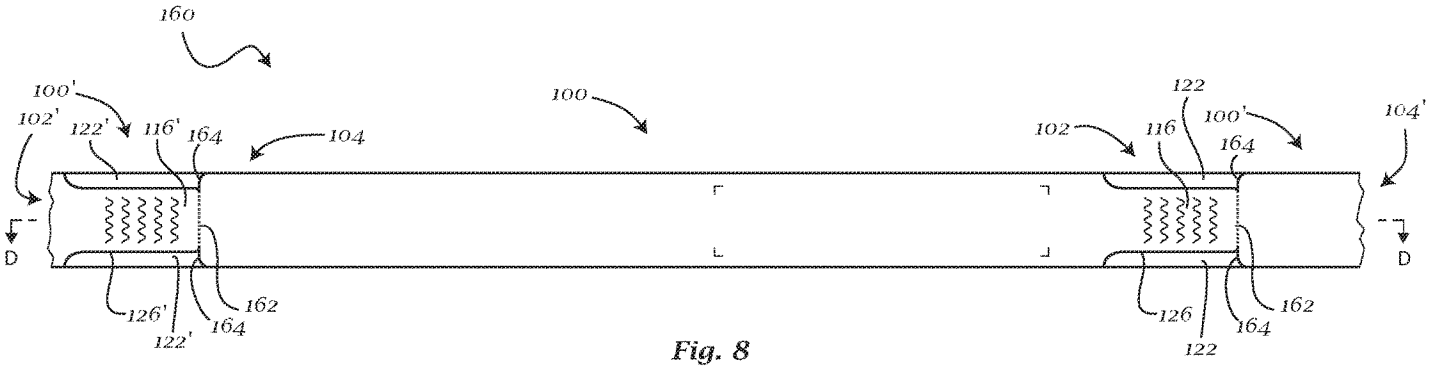
FIG. 8 is a top view of a continuous strip of identification bracelets according to the exemplary embodiment of FIG. 1.
Figure 9:
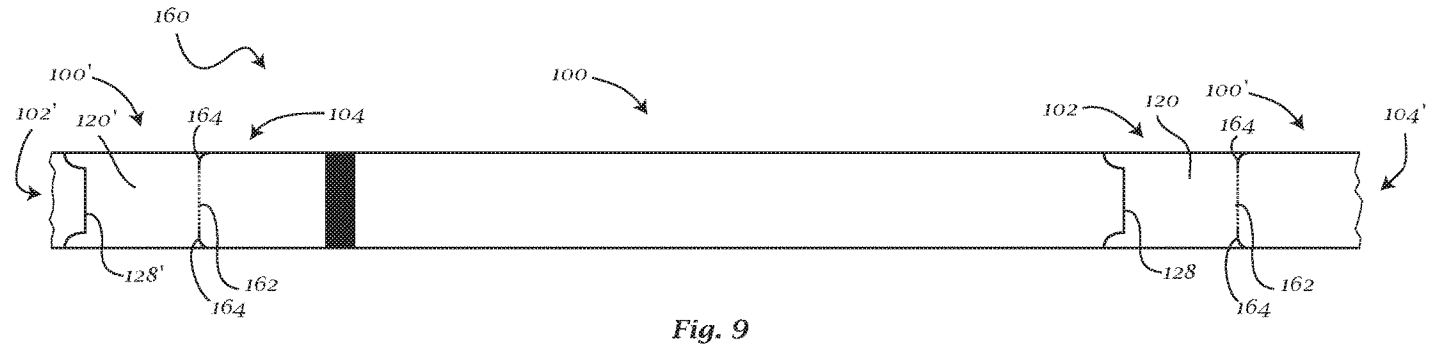
FIG. 9 is a bottom view of a continuous strip of identification bracelets according to the exemplary embodiment of FIG. 1.
Figure 10:
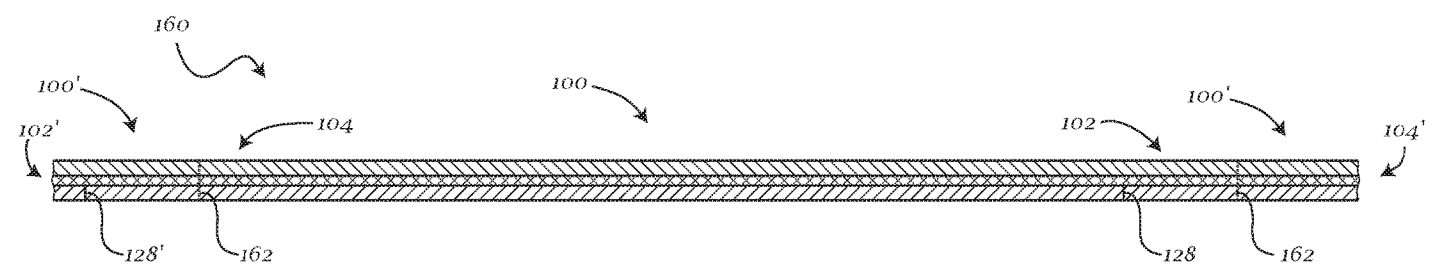
FIG. 10 is a cross-sectional view of a continuous strip of identification bracelets along line D-D of FIG. 8.

In some exemplary embodiments, bracelets 100 can be provided in a continuous strip 160 of detachably connected bracelets, as shown in FIGS. 8-10, in which a first end 102 of a bracelet 100 is connected to a second end 104 of an adjacent bracelet 100'. The detachable connection between bracelets 100, 100' can be provided by a perforated line 162 formed through top layer 150, adhesive layer 152 and bottom layer 154. Perforated line 162 may extend for a portion of the width of bracelet 100, for example substantially similar to and along the width of securement portion 116. Between the gripping sections 122 of cover 120 of bracelet 100 and second end 104 of adjacent bracelet 100', cut lines 164 may be formed through top layer 150, adhesive layer 152 and bottom layer 154, resulting in a complete separation between the gripping sections and the adjacent bracelet along the length of cut lines 164. This increases the ease of separation of bracelets 100 and 100' from each other and also prevents unintended or premature separation of cover 120 from bracelet 100 during bracelet separation. The continuous strip 160 of detachable bracelets may be provided as a roll or spool, and the bracelets 100 may be mounted in a dispenser and/or then be fed into a suitable printer, such as one adapted for feeding and printing on continuous strips, or any other compatible device known in the art.

In the exemplary embodiment illustrated in FIGS. 8-9, cut lines 164 have a generally arcuate shape, resulting in second end 104 of the bracelet having rounded corners. Similarly, score lines 126 may have arcuate portions proximate first end 102, resulting in the distal end of securement portion 116 having rounded corners as well. The rounded corners can serve to increase the comfort of bracelet 100 to the wearer, due to the lack of sharp corners that may repeatedly contact the skin and cause unpleasant sensations or irritation. However, it should be appreciated that any desired configuration may be contemplated and provided for these and other features of bracelet 100 without departing from the scope or spirit of the invention. Furthermore, it should be understood that, as contemplated herein, the rounded corners shall not be considered as reducing the width of the body of bracelet 100.

Figure 11D:
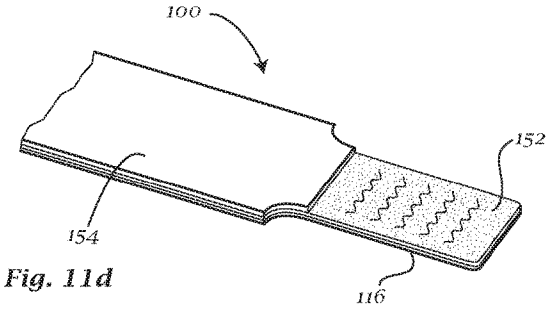
FIG. 11*d* is a bottom perspective view of the first end of an exemplary embodiment of an identification bracelet, showing the adhesive of the securement portion exposed.
Figure 11E:
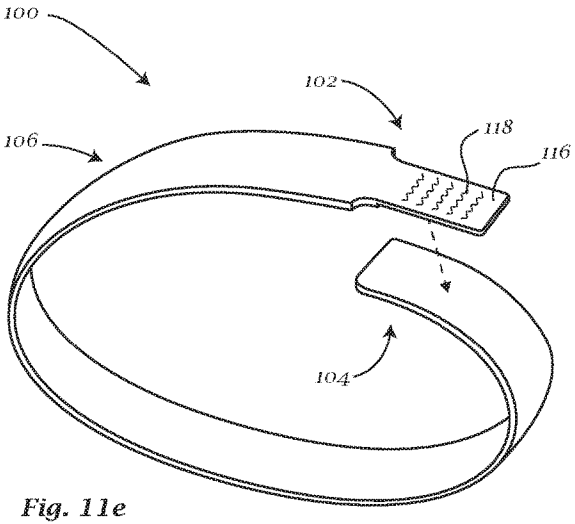
FIG. 11*e* is a top perspective view of an exemplary embodiment of an identification bracelet, showing the bracelet fastening step.
Figure 11A:
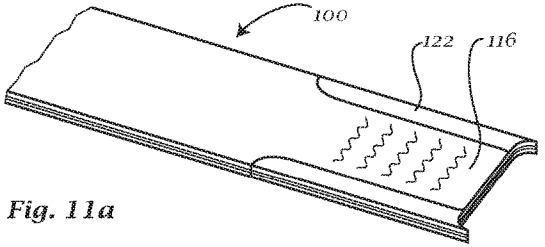
FIG. 11*a* is a top perspective view of the first end of an exemplary embodiment of an identification bracelet, showing the cover attached to the securement portion.
Figure 11B:
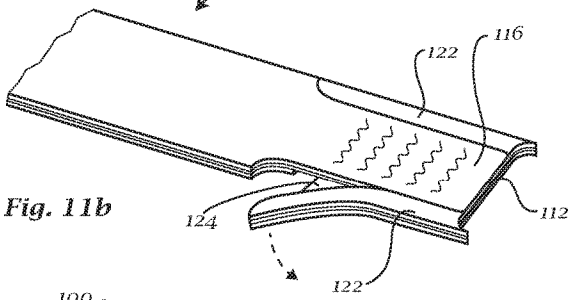
FIG. 11*b* is a top perspective view of the first end of an exemplary embodiment of an identification bracelet, showing the cover being peeled away from the securement portion.
Figure 11C:
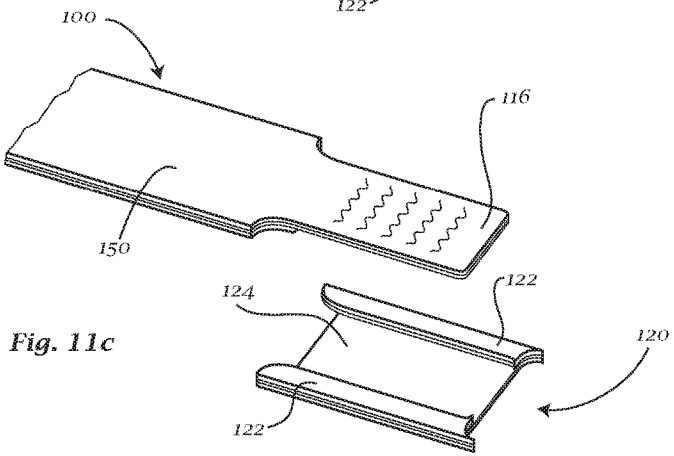
FIG. 11*c* is a top perspective view of the first end of an exemplary embodiment of an identification bracelet, showing the cover separated from the securement portion.

FIGS. 11*a*-11*e* illustrate the steps for manipulating bracelet 100 so as to fasten the bracelet to an object to be identified. In the initial configuration of FIG. 11*a*, peel-off cover 120 is coupled to bracelet 100, and so the bracelet has a substantially uniform width. Peel-off cover 120 may then be gripped at one of the gripping sections 122, for example by pinching the gripping section between the thumb and a finger. Cover 120 can then be gradually separated from bracelet 100 by peeling cover 120 away from the bracelet and towards edge 112, as shown in FIG. 11*b*. The peeling action causes release section 124 to detach from adhesive layer 152 of securement portion 116, in turn causing the other gripping section 122 to detach from bracelet 100 as well, resulting in a tapered securement portion 116, and a separate cover 120, shown in FIG. 11*c*. The width of the tapered securement portion 116, and consequently of end 102, is therefore less than the width of the remainder of the body of bracelet 100. Furthermore, the thickness of the tapered securement portion 116, and consequently of end 102, is also less than the thickness of the remainder of the body of bracelet 100. With bottom layer 154 removed at the securement portion, adhesive layer 152 is exposed, as shown in FIG. 11*d*. As shown in FIG. 11*e*, bracelet 100 may now be encircled around an object to be identified, and securement portion 116 can be adhered to the top layer 150 of bracelet 100, at second end 104 or further along the length of bracelet 100, so as to achieve a desired circumference for the bracelet. If removal of the bracelet is attempted, tamper-evident score lines 118 can cause the securement portion 116 to tear, thereby indicating attempted removal of the bracelet.

Figure 12:
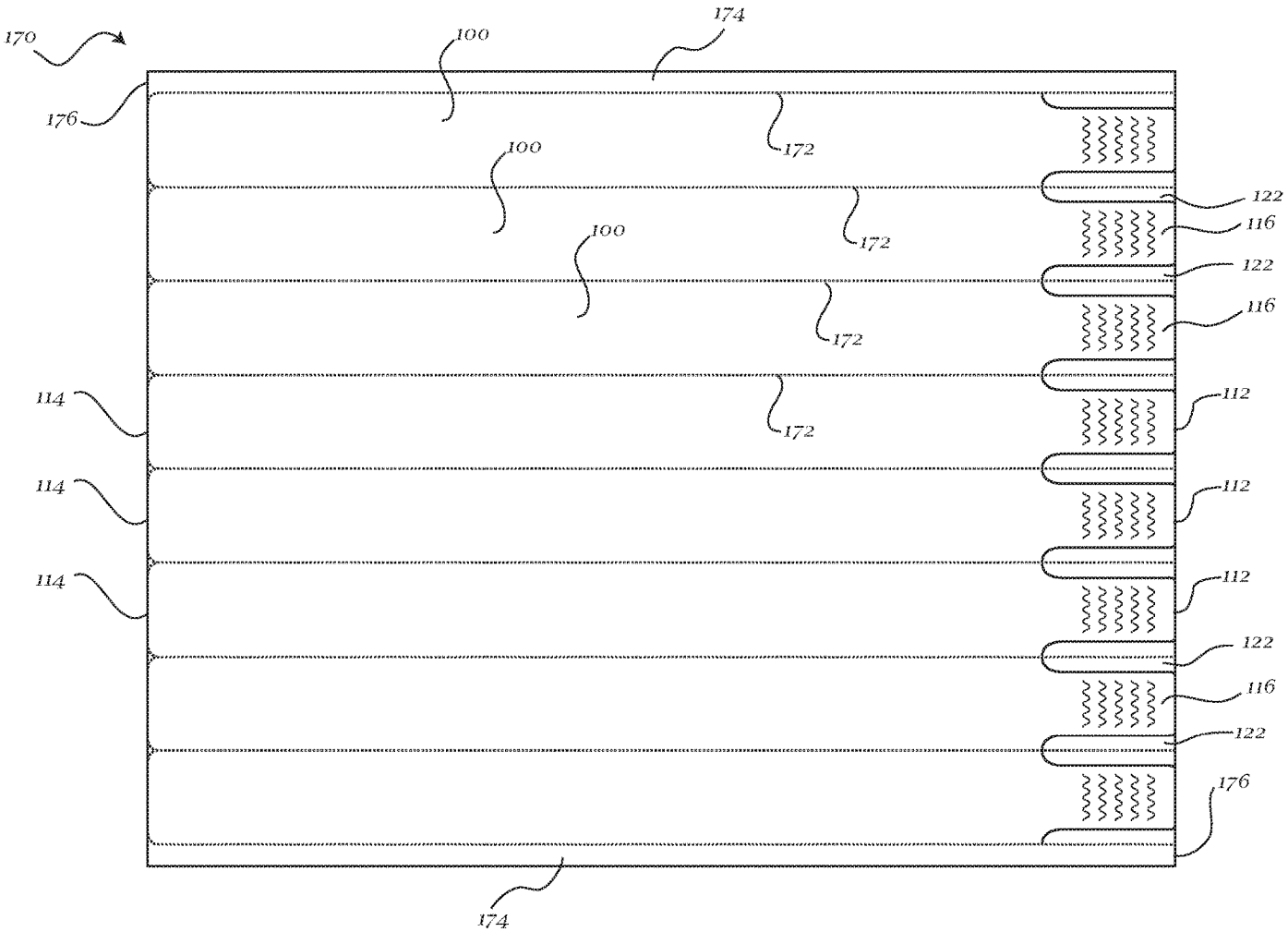
FIG. 12 is a top view of a sheet of identification bracelets according to the exemplary embodiment of FIG. 1.

FIG. 12 shows an exemplary alternative configuration of a plurality of bracelets 100, which can be provided as a sheet 170 of bracelets. Such sheets can be used in printers adapted for feeding and printing on a variety of standard-size sheets. Sheet 170 includes a plurality of bracelets 100 disposed in side-by-side relation. Perforated lines 172 are provided for separation of bracelets 100 from each other, and define longitudinal edges 108, 110 of the bracelets. Separation of bracelets along perforated lines 172 should be sufficiently easy so as not to cause unintended separation of cover 120 from wristband 100. Margins 174 are provided as necessary to conform sheet 170 to a desired standardized or other paper size. In the illustrated embodiment, margins 174 are provided longitudinally, while transverse edges 112, 114 of bracelets 100 are defined by the transverse edges 176 of sheet 170. However, depending on the desired paper format and wristband size as well as on printer specifications, margins 174 may also be provided transversely rather than longitudinally, both transversely and longitudinally, or may be absent. In the case where margins are provided transversely, perforated lines are provided at the transverse edges 112, 114 of the bracelets for separation of the bracelets.

Figure 13A:
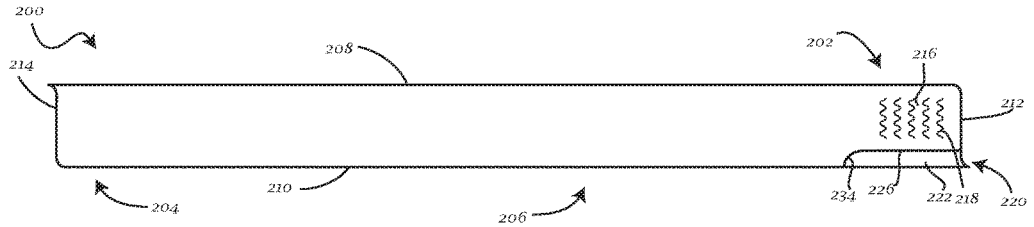
FIG. 13*a* is a top view of a second exemplary embodiment of an identification bracelet.
Figure 13B:
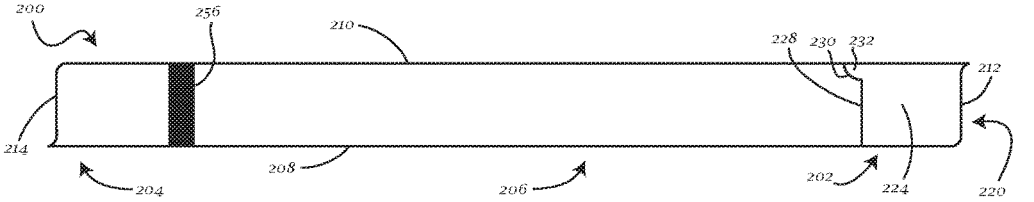
FIG. 13*b* is a bottom view of a second exemplary embodiment of an identification bracelet.

The securement section and cover at the first end of the bracelet can be provided in various configurations while conforming with the spirit of the invention described herein. Such configurations may be adapted for the particular requirements of manufacturers and end users, as desired. For example, another embodiment of the bracelet is shown in FIGS. 13*a*-13*b* and denoted by reference numeral 200. In this exemplary embodiment, similar features are denoted by similar reference numerals, but with a hundreds digit of 2. Bracelet 200 has a substantially similar structure and configuration to bracelet 100, except that only one gripping section 222 is provided at first end 202, the gripping section 222 being defined by longitudinal edge 210, score line 226, and transverse edge 212. Consequently, the score line 228, which defines the extent of cover 220 on the bottom face of bracelet 200, includes only one extending portion 230 which is coextensive with the extending portion 234 of score line 226.

Figure 14A:
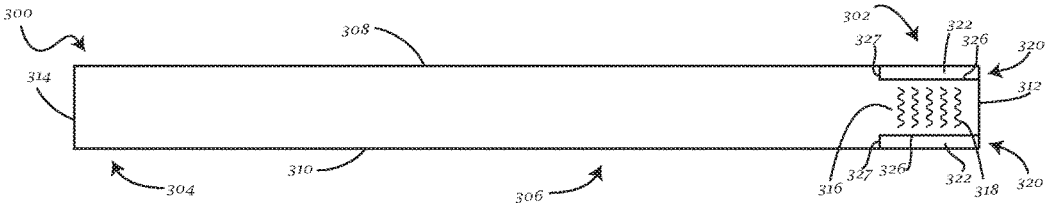
FIG. 14*a* is a top view of a third exemplary embodiment of an identification bracelet.
Figure 14B:
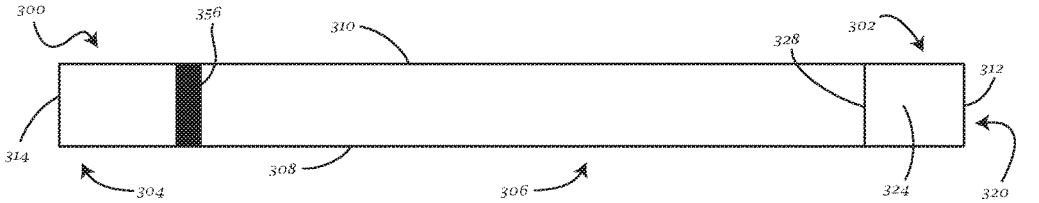
FIG. 14*b* is a bottom view of a third exemplary embodiment of an identification bracelet.
Figure 14C:
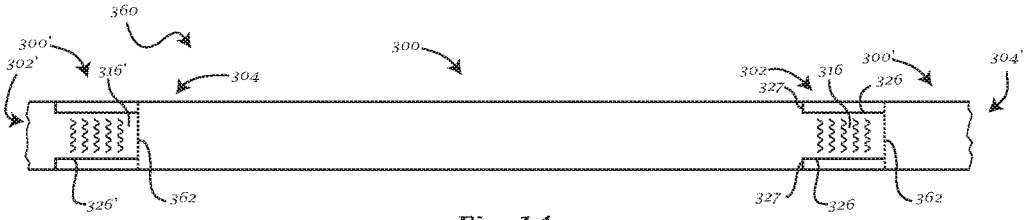
FIG. 14*c* is a top view of a continuous strip of identification bracelets according to the exemplary embodiment of FIG. 14*a*.

Another exemplary embodiment of the bracelet is shown in FIGS. 14*a*-14*c* and denoted by reference numeral 300, with similar features being denoted by similar reference numerals, but with a hundreds digit of 3. Bracelet 300 has a substantially similar structure and configuration to bracelet 100, except that bracelet 300 lacks the rounded corners, extending portions 130, 134, and tabs 132 of bracelet 100. Thus, the gripping sections 322 of bracelet 300 are substantially rectangular, and defined by score lines 326 and score lines 327 which extend from score lines 327 to longitudinal edges 308 and 310. Similarly, score line 328 extends linearly between longitudinal edges 308 and 310. Where score line 328 overlaps score lines 327, a cut line may be formed through the entire thickness of bracelet 300, so as to increase the ease of separation of cover 320. In the exemplary embodiment of the continuous strip of bracelets 360, perforated line 362 may extend the full distance between longitudinal edges 308 and 310. Alternatively, perforated line 362 may extend substantially along the width of securement portion 316, while cut lines (not shown) through the entire thickness of bracelet 300 may be provided along the width of gripping sections 322, between an end of perforated line 362 and longitudinal edge 308 or 310.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An identification bracelet, comprising:

an elongated body having a first end and a second end;

a securement portion disposed at the first end, the securement portion including an adhesive; and a cover, the cover comprising a release section in releasable engagement with the adhesive, the release section having a proximal edge spaced longitudinally inwardly from the transverse edge of the first end, and a gripping section connected to the release section, the gripping section being separated from the securement portion by at least one score line extending between the transverse edge of the first end and a longitudinal edge of the body;

wherein, proximate the longitudinal edge of the body, a portion of the at least one score line overlaps a portion of the proximal edge of the release section; and when the cover is moved to a non-engagement relationship with the adhesive, the width of the first end is less than the width of the remainder of the body.

2. The identification bracelet of claim 1, wherein the width of the securement portion and the width of the gripping section is equal to the width of the body.

3. The identification bracelet of claim 1, further comprising two gripping sections disposed along opposing longitudinal edges of the bracelet.

4. The identification bracelet of claim 1, wherein the body comprises a first layer bonded to and coextensive with a second layer.

5. The identification bracelet of claim 4, wherein:

the first layer is bonded to the second layer by an adhesive layer; and the adhesive of the securement portion is formed from a portion of the adhesive layer.

6. The identification bracelet of claim 4, wherein:

the release section includes the second layer; and the gripping section includes the first layer and the second layer.

7. The identification bracelet of claim 1, wherein, when the cover is moved to a non-engagement relationship with the adhesive, the thickness of the first end is less than the thickness of the remainder of the body.

8. An identification bracelet, comprising:

an elongated body including a first layer bonded to a second layer;

a securement portion disposed at a distal end of the body and comprising the first layer and an adhesive layer; and a cover detachably coupled to the bracelet, the cover including a release section comprising the second layer and a gripping section comprising the first layer and the second layer, the release section being releasably engaged with the adhesive layer of the securement portion, and the gripping section disposed between a longitudinal edge of the body and the securement portion;

a first score line formed through the first layer, separating the securement portion and the gripping section and terminating at a longitudinal edge of the body;

a second score line formed through the second layer and extending between both longitudinal edges of the body;

wherein, proximate a longitudinal edge of the body, a portion of the first score line overlaps a portion of the second score line.

9. The identification bracelet of claim 8, wherein, when the cover is moved to a non-engagement relationship with the adhesive layer, the width of at least a portion of the distal end of the body is less than the width of the remainder of the body.

10. The identification bracelet of claim 8, wherein the width of the securement portion and the width of the gripping section is equal to the width of the remainder of the body.

11. The identification bracelet of claim 8, further comprising two gripping sections disposed along opposing longitudinal edges of the bracelet.

12. The identification bracelet of claim 8, wherein:

the first layer is bonded to the second layer by the adhesive layer; and the first layer, the second layer, and the adhesive layer are coextensive with the body.

13. The identification bracelet of claim 8, wherein, when the cover is moved to a non-engagement relationship with the adhesive layer, the thickness of at least a portion of the distal end of the body is less than the thickness of the remainder of the body.

14. An identification bracelet, comprising:

an elongated body comprising a first layer bonded to a second layer by an adhesive layer disposed therebetween;

a securement portion disposed at an end of the body and formed from the first layer and the adhesive layer; and a cover comprising a release section and at least one gripping section, the release section formed from the second layer, the release section being releasably engaged with the adhesive layer of the securement portion, the at least one gripping section disposed between a longitudinal edge of the body and the securement portion, and the at least one gripping section formed from the first layer, the adhesive layer, and the second layer;

at least one first score line formed through the first layer and the adhesive layer, separating the securement portion and the at least one gripping section, and terminating at a longitudinal edge of the body;

a second score line formed through the second layer and extending between both longitudinal edges of the body;

wherein, proximate a longitudinal edge of the body, a portion of the at least one score line overlaps a portion of the second score line.

15. The identification bracelet of claim 14, wherein:

when the cover is engaged with the securement portion, the width of the identification bracelet is substantially uniform; and when the cover is moved to a non-engagement relationship with the adhesive, the width of at least a portion of the end of the body is less than the width of the remainder of the body.

16. The identification bracelet of claim 14, wherein the width of the securement portion and the width of the at least one gripping section is equal to the width of the body.

17. The identification bracelet of claim 14, further comprising two gripping sections disposed along opposing longitudinal edges of the bracelet.

18. The identification bracelet of claim 14, wherein the first layer, the second layer, and the adhesive layer are coextensive with the body.

19. The identification bracelet of claim 14, wherein, when the cover is moved to a non-engagement relationship with the adhesive, the thickness of at least a portion of the end of the body is less than the thickness of the remainder of the body.

20. The identification bracelet of claim 3, wherein each gripping section of the two gripping sections is disposed between the securement portion and a corresponding longitudinal edge of the bracelet, along at least the entire longitudinal length of the securement portion.

* * * * *